United States Patent [19]

Fiedler

[11] 4,173,502

[45] Nov. 6, 1979

[54] METHOD OF PRODUCING SILICON-IRON SHEET MATERIAL WITH BORON ADDITION, AND PRODUCT

[75] Inventor: Howard C. Fiedler, Schenectady, N.Y.

[73] Assignee: General Electric Company, Schenectady, N.Y.

[21] Appl. No.: 881,541

[22] Filed: Feb. 27, 1978

Related U.S. Application Data

[63] Continuation of Ser. No. 749,117, Dec. 9, 1976, abandoned, which is a continuation-in-part of Ser. No. 677,146, Apr. 15, 1976, abandoned.

[51] Int. Cl.[2] ..... H01F 1/04

[52] U.S. Cl. ..... 148/113; 148/31.5

[58] Field of Search ..... 148/27, 31.5, 111, 112, 148/113, 16; 204/37 R, 100; 427/127; 428/432

[56] References Cited

U.S. PATENT DOCUMENTS

| | | | |
|---|---|---|---|
| 3,054,732 | 9/1962 | McQuade | 204/37 |
| 3,540,948 | 11/1970 | Benford et al. | 148/111 |
| 3,583,887 | 6/1971 | Steger et al. | 148/113 |
| 3,676,227 | 7/1972 | Matsumoto et al. | 148/111 |
| 3,681,152 | 8/1972 | Staley et al. | 148/113 |
| 3,700,506 | 10/1972 | Tanaka et al. | 148/111 |
| 3,905,842 | 9/1975 | Grenoble | 148/111 |
| 3,905,843 | 9/1975 | Fiedler | 148/111 |
| 3,957,546 | 5/1976 | Fiedler | 148/111 |
| 4,097,343 | 6/1978 | Arendt et al. | 204/100 |
| 4,116,730 | 9/1978 | Arendt et al. | 148/113 |

*Primary Examiner*—L. Dewayne Rutledge
*Assistant Examiner*—John P. Sheehan
*Attorney, Agent, or Firm*—Leo I. MaLossi; Joseph T. Cohen

[57] ABSTRACT

Addition of as little as six parts per million boron to the magnesia final anneal coating on silicon-iron strip containing only about 1.5 ppm insures secondary recrystallization while the addition of 70 ppm boron to the coating on a strip containing 10 to 15 ppm boron results in substantial reduction in losses without affecting permeability of the final product when the nitrogen content of the alloy is in the 80 to 90 ppm range.

10 Claims, 6 Drawing Figures

PERMEABILITY AT 10H
2000
1900
1800
1700
1600
1500
742
699
721
84 PPM N
0.025% Mn
0.010% S
Mn/S=2.5
42 PPM N
48 PPM N
715
696
690
703
55 PPM N
72 PPM N
62 PPM N
43 PPM N
0.025% Mn
0.014% S
Mn/S=1.8
715
692
704
694
719
93 PPM N
42 PPM N
60 PPM N
0.025% Mn
0.018% S
Mn/S=1.4
0
15
30
45
60
75
MAXIMUM PPM BORON AVAILABLE TO SILICON-IRON FROM COATING

METHOD OF PRODUCING SILICON-IRON SHEET MATERIAL WITH BORON ADDITION, AND PRODUCT

This is a continuation, of application Ser. No. 749,117, filed Dec. 9, 1976, now abandoned, which is a continuation-in-part of my copending patent application Ser. No. 677,146, filed Apr. 15, 1976 now abandoned, and assigned to the assignee hereof.

The present invention relates generally to the art of producing electrical steel and is more particularly concerned with a novel method of producing singly-oriented silicon-iron sheet through the use in the electrically-insulating coating on a boron-containing silicon-iron magnetic sheet of small amounts of boron in critical proportion to the boron and nitrogen contents of the sheet.

CROSS REFERENCE

This invention is related to the invention disclosed and claimed in U.S. patent application Ser. No. 677,147 now abandoned, filed Apr. 15, 1976, in the name of Carl M. Maucione for "Method of Producing Silicon-Iron Sheet Material With Boron Addition, and Product" assigned to the assignee hereof and directed to the novel concept of incorporating in the final anneal coating on silicon-iron sheet material a relatively very small amount of boron to cause secondary recrystallization of the alloy during the final anneal or to produce a final product having substantially improved permeability.

BACKGROUND OF THE INVENTION

The sheet materials to which this invention is directed are usually referred to in the art as "electrical" silicon steels or, more properly, silicon-irons and are ordinarily composed principally of iron alloy with about 2.2 to 4.5 percent silicon and relatively minor amounts of various impurities and very small amounts of carbon. These products are of the "cube-on-edge" type, more than about 70 percent of their crystal structure being oriented in the (110)[001] texture, as described in Miller Indices terms.

Such grain-oriented silicon-iron sheet products are currently made commercially by the sequence of hot rolling, heat treating, cold rolling, heat treating, again cold rolling and then final heat treating to decarburize, desulfurize and recrystallize. Ingots are conventionally hot-worked into a strip or sheet-like configuration less than 0.150 inch in thickness, referred to as "hot-rolled band." The hot-rolled band is then cold rolled with appropriate intermediate annealing treatment to the finished sheet or strip thickness usually involving at least a 50 percent reduction in thickness, and given a final or texture-producing annealing treatment.

As disclosed and claimed in U.S. Pat. No. 3,905,842, issued Sept. 16, 1975 to Herbert E. Grenoble and assigned to the assignee hereof, the magnetic properties of such sheet materials can be very considerably improved by incorporating boron in the metal so that it is present there at the time of the final or texture-developing anneal. As stated in that patent, the amount of boron required to produce that result is quite small but highly critical.

Similarly, it is disclosed in U.S. Pat. No. 3,905,843, issued Sept. 16, 1975 to Howard C. Fiedler and assigned to the assignee hereof, that such use of boron in the metal in proportion to nitrogen will enable the corresponding substantial improvement in magnetic properties of a product made by the process including cold rolling in two stages, including an intermediate anneal.

Still another related disclosure concerning the use of small but critical amounts of boron in silicon-iron is set forth in U.S. Pat. No. 3,957,546 of Howard C. Fiedler assigned to the assignee hereof, which defines a process of direct cold rolling to the final gauge from the hot band stage with consistently good magnetic properties in the final product through maintenance of boron-nitrogen and manganese-sulfur ratios in the metal within certain critical ranges.

SUMMARY OF THE INVENTION

I have discovered that new and important results and advantages in addition to those set forth in referenced patent application Ser. No. 677,147 can be obtained consistently by limiting the amount of boron in a cold rolled and decarburized silicon-iron sheet to one particular range and by limiting the amount of boron available in the electrically-insulating coating on the sheet to another particular range. Further, I have found that it is essential to these new results and advantages that the total boron in the alloy and the coating thereon be limited to a certain maximum. Still further, I have found that by proportioning the alloy nitrogen content in a particular manner to the middle and upper ranges of total boron content of the alloy and its coating, these new results can be obtained regularly and routinely.

Specifically, I have found that secondary recrystallization can consistently be obtained during the final anneal of silicon-iron containing as little as 1.5 ppm boron when there is available in the electrically-insulating coating thereon as little as six ppm boron. Additionally, much greater total amounts of boron in the alloy and its coating will likewise consistently result in products having superior magnetic properties, providing that the total boron does not exceed about 90 ppm and also providing that the alloy boron content does not exceed about 50 ppm as the final anneal is begun. Still further, when the boron content of the alloy plus that available in the coating exceeds about 40 ppm, the nitrogen content of the alloy should be greater than about 70 ppm and preferably in the range from 80 to 90 ppm for consistently good results in terms of the magnetic properties of the ultimate singly-oriented, silicon-iron, magnetic sheet product.

Still another discovery which I have made is that, except for the extremities of the above critical range of boron available in the coating, increases in the boron content of the coating result in significant decreases in losses in the finished sheet product and, to a lesser degree, result in improvement in the superior permeability of the product.

I have further found that such increases in coating boron content do not materially affect grain size of the final product sheet material. This is surprising in view of the disclosure by Matsumato et al in U.S. Pat. No. 3,676,277 that such additions result in secondary grains somewhat smaller than normal and have no effect upon the permeability of the ultimate product.

Still another finding that I have made is that the ratio of manganese to sulfur which is limited to 2.1 in the process disclosed and claimed in referenced U.S. Pat. No. 3,957,546 can run as high as 2.5 in accordance with the present invention with consistently good end-product magnetic properties.

As set out in referenced patent application Ser. No. 677,147, the requirements of this invention in respect to the proportions of boron in the alloy and its coating, the nitrogen content of the alloy and the manganese and sulfur content of the alloy can all be met without difficulty. Again, as stated in the copending patent application, one has the choice of applying the boron with the magnesia slurry or other coating material in similar form, or the coating may be provided as disclosed in U.S. Pat. No. 3,054,732 (issued Sept. 18, 1962 to McQuade and assigned to the assignee hereof) and the coated sheet metal then contacted with an aqueous solution of a suitable boron compound. The latter procedure can take the form of a dipping operation or the aqueous solution may be brushed or sprayed on the coating, as desired. Suitable boron sources for this purpose include $H_3BO_3$ and $Na_2B_4O_7$, but it will be understood that other boron-containing compounds may be used individually or in a mixture and preferably in solution of water or other suitable vehicle to insure easy, uniform distribution over the coating surface. It will be understood that a basic requirement of the boron source in the coating is that it be decomposable under the conditions of the final anneal so that the boron can diffuse into the alloy surface to produce the new results and advantages set out above.

From the foregoing, it will be understood that this invention has both method and product aspects. The product is a decarburized, coated, cold-rolled sheet or strip of final gauge thickness which contains boron that in criticl proportion to and in combination with the boron in the coating and the nitrogen in the metal will enable the development of the desired magnetic properties through secondary recrystallization during the final anneal. The process by which this coated sheet is produced is likewise novel as is the overall process of producing the final desired sheet material from a silicon-iron metal through a new combination of method steps including new critical boron and nitrogen proportioning steps.

Briefly described, in its article aspect this invention takes the form of an electrically-insulated magnetic sheet of fine-grained, primary-recrystallized, magnetic silicon-iron which contains between about 1.5 to 50 ppm boron and between about 30 and 90 ppm nitrogen and has a thin, tightly-adhering, water-insoluble metal hydroxide coating containing between about six and 90 ppm boron proportioned to the boron content of the alloy sheet so that the total amount is between about 7.5 and 90 ppm.

Similarly described, the method of this invention comprises the steps of providing this intermediate sheet product and subjecting it to a final heat treatment to develop the cube-on-edge secondary recrystallization in it.

BRIEF DESCRIPTION OF THE DRAWINGS

Data gathered during experiments described below are graphically illustrated in the accompanying drawings, in which.

DETAILED DESCRIPTION OF THE INVENTION

Figure 1:
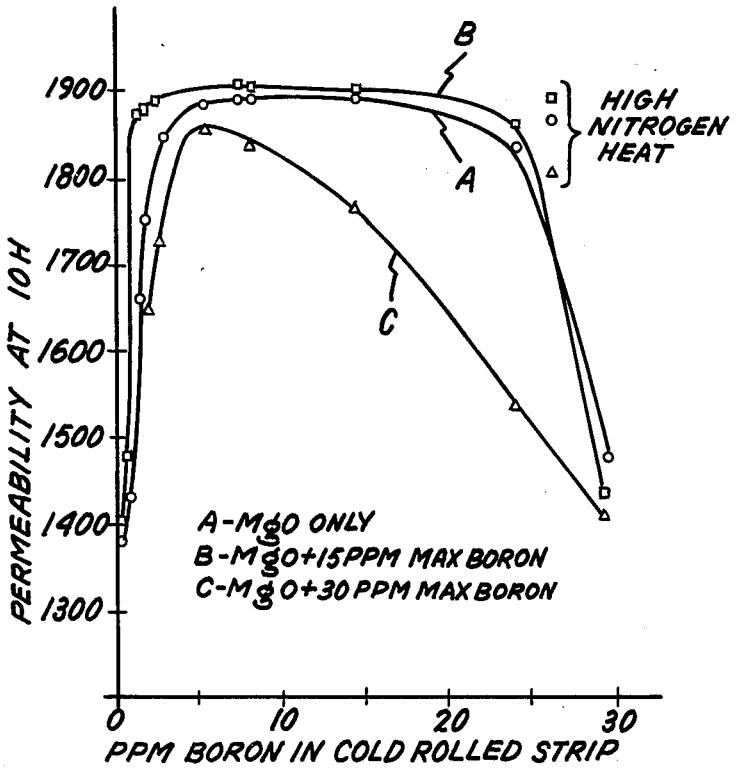
FIG. 1 is a chart on which permeability is plotted against cold-rolled strip boron content, the three curves showing the effects of boron additions to the strip magnesia coating.

In carrying out this invention, one may provide the intermediate sheet product described above by preparing a silicon-iron melt of the requiried chemistry, and then casting and hot rolling to intermediate thickness. Thus, the melt on pouring will contain from 2.2 to 4.5 per cent silicon, from about 1.5 to 50 ppm boron and about 30 to 90 ppm nitrogen in the ratio range to boron of one to 15 parts to one, manganese up to about 0.10 per cent and sulfur up to a ratio of 2.5 parts of manganese per part of sulfur, the remainder being iron and small amounts of incidental impurities. Following anneal, the hot band is cold rolled with or without intermediate anneal to final gauge thickness and then decarburized.

The resulting fine-grained, primary recrystallized silicon-iron sheet material in whatever manner produced is processed to provide the essential boron-containing coating of this invention in preparation for the final texture-developing anneal. Preferably, the coating step is accomplished electrolytically as described in U.S. Pat. No. 3,054,732, referenced above, a uniform coating of $Mg(OH)_2$ about 0.5 mil thick thereby being applied to the sheet. The coated sheet is then dipped in aqueous solution of boric acid or sodium borate or other suitable boron compound solution which is preferably relatively dilute, containing of the order of five to 10 grams per liter of the boron compound.

As the final step of the process of this invention, the thus-coated sheet is heated in hydrogen to cause secondary grain growth which begins at about 950° C. As the temperature is raised at about 50° C. per hour to 1000° C., the recrystallization process is completed and heating may be carried on to up to 1175° C. if desired to insure complete removal of residual carbon, sulfur and nitrogen.

The following illustrative, but not limiting, examples of my novel process as actually carried out with the new results indicated above will further inform those skilled in the art of the nature and special utility of this invention.

EXAMPLE I

Twelve laboratory heats were melted in an air induction furnace under an argon cover using eletrolytic iron and 98 percent ferrosilicon, all containing 3.1 percent silicon, 0.1 percent copper and 0.03 percent chromium. The same amount of sulfur (0.024 percent) as iron sulfide was added to each heat, the sulfur analyses range 0.033 percent down to 0.019 percent with an average of 0.026 percent.

Slices 1.75 inch thick were cut from ingots cast from these melts and were hot rolled from 1200° C. in six passes to a thickness of about 90 mils. Following pickling, the hot band samples were heat treated at 950° C., the time between 930 and 950° C. being about three minutes. The hot bands were then cold rolled directly to 10.8 mils and analyzed with the results set forth in Table I:

TABLE I

| | Composition as Determined on Cold-Rolled Strip | | | | | |
|---|---|---|---|---|---|---|
| Heat | ppm B | ppm N | ppm O | % Mn | % S | % C |
| 1 | < 1 | 68 | 70 | 0.034 | 0.025 | 0.038 |
| 2 | 1.2 | — | — | .036 | .033 | .037 |
| 3 | 1.6,1.4 | — | — | .035 | .025 | .038 |
| 4 | 1.8 | — | — | .034 | .019 | .040 |
| 5 | 2.4,3.1 | 49 | 76 | .035 | .029 | .033 |
| 6 | 5.6 | 48 | 90 | .035 | .025 | .044 |
| 7 | 6.9 | 46 | 88 | .036 | .030 | .037 |
| 8 | 7.4 | 52 | 115 | .036 | .021 | .039 |
| 9 | 14 | 50 | 98 | .035 | .031 | .036 |
| 10 | 24 | 46 | 96 | .036 | .024 | .038 |
| 11 | 26,25 | 62 | 70 | .036 | .022 | .040 |
| 12 | 29 | 47 | 69 | .035 | .023 | .038 |

Epstein-size strips of the cold-rolled material were decarburized to about 0.007 percent by heating at 800° C. in 70° F. dew point hydrogen. The carburized strips were brushed with milk of magnesia to a weight gain of about 40 milligrams per strip and boron additions were made to some of the magnesia coated strips using either a 0.5 or 1.0 percent boric acid solution which deposited sufficient boron on the coating that if it were all taken up by the silicon-iron, the boron content of the metal would be increased by 15 or 30 ppm, respectively. The resulting coated strips, including both those brushed with the boric acid solution and those not so treated, were subjected to a final anneal consisting of heating at 40° C. per hour from 800° C. to 1175° C. in dry hydrogen and holding at the latter temperature for three hours.

Figure 2:
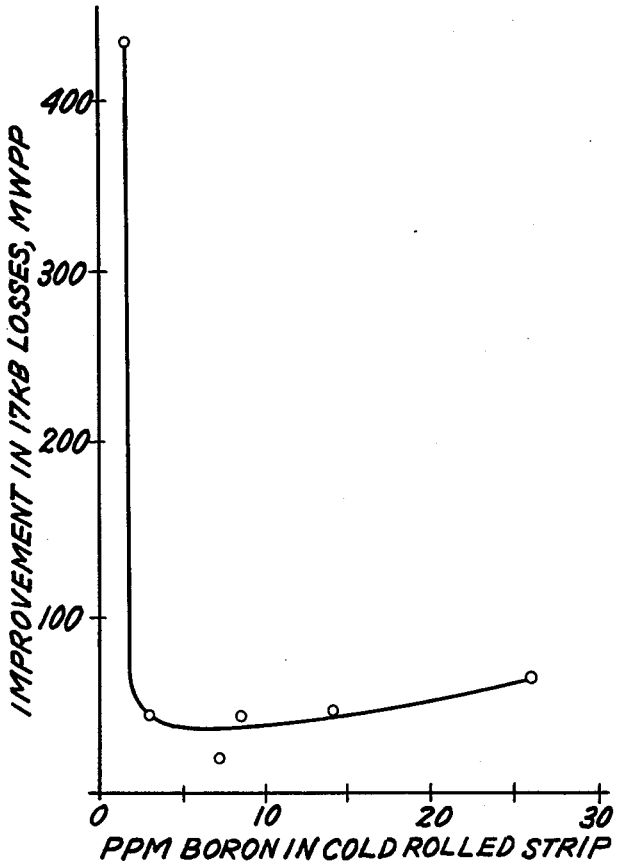
FIG. 2 is a chart on which improvement in losses is plotted against cold-rolled strip boron content, the curve showing the effect of brushing the magnesia coating with dilute boric acid solution prior to the final anneal.

Magnetic properties of the ultimate products of the foregoing process of this invention and those representing the control specimens are set forth in Table II and in FIGS. 1 and 2:

TABLE II

| | Magnetic Properties Afer Final Anneal in Hydrogen | | | | | | |
|---|---|---|---|---|---|---|---|
| | | MgO Only | | MgO+15ppm B | | MgO+30ppm B | |
| Heat | ppm B | 17kB | μ10H | 17kB | μ10H | 17kB | μ10H |
| 1 | <1 | — | 1383 | — | 1402 | — | 1394 |
| 2 | 1.2 | — | 1432 | 1322 | 1483 | — | 1467 |
| 3 | 1.5 | 1136 | 1664 | 730 | 1873 | 1000 | 1678 |
| 4 | 1.8 | 929 | 1751 | 739 | 1876 | 1094 | 1655 |
| 5 | 2.7 | 771 | 1849 | 725 | 1881 | 940 | 1730 |
| 6 | 5.6 | 750 | 1887 | — | — | 741 | 1856 |
| 7 | 6.9 | 696 | 1892 | 678 | 1908 | — | — |
| 8 | 7.4 | 749 | 1890 | 702 | 1898 | 755 | 1845 |
| 9 | 14 | 747 | 1891 | 701 | 1900 | 870 | 1768 |
| 10 | 24 | 813 | 1844 | 736 | 1869 | 1322 | 1536 |
| 11 | 26 | 754 | 1873 | 690 | 1900 | 803 | 1805 |
| 12 | 29 | — | 1472 | — | 1423 | — | 1406 |

Table II and FIG. 1 illustrate that the effect of boron additions to the coating on the permeability. Providing boron in the coating in amount representing a total theoretically available to the alloy of 15 ppm greatly enhances the magnetic properties, particularly those of the alloys initially containing only 1.5 or 1.8 ppm boron. Doubling the coating boron content was formed to consistently reduce the permeability of the ultimate strip product. Degradation of permeability of the high boron strip specimens might be rationalized in terms of an imbalance in the boron/nitrogen ratio, as evidenced by the very different results obtained in the high nitrogen heat (No. 11).

Curve A of FIG. 1 represents those data obtained with specimens having magnesia coatings untreated with boron solution, while Curves B and C represent, respectively, data obtained with specimens bearing magnesia coatings treated with boron-containing solution providing 15 ppm and 30 ppm total boron on the basis of the alloy in each instance. The improvement in loss resulting from boron coating additions is illustrated in FIG. 2. The large improvement for the two lowest boron alloys is due mainly to the improved permeability while the approximately 50 mwpp improvement of the higher boron content alloys with little or no change in permeability is typical behavior of both laboratory and mill heats.

EXAMPLE II

In another experiment designed to test the capabilities of this new process, a commerical melt was prepared using BOF silicon-iron as described in referenced U.S. Pat. No. 3,905,843, the melt having the following ladle analyses:

| | |
|---|---|
| Silicon | 3.10% |
| Copper | 0.29% |
| Manganese | 0.033% |
| Sulfur | 0.019% |
| Carbon | 0.024% |
| Boron | 0.0015% |
| Nitrogen | 0.0058% |

Figure 3:
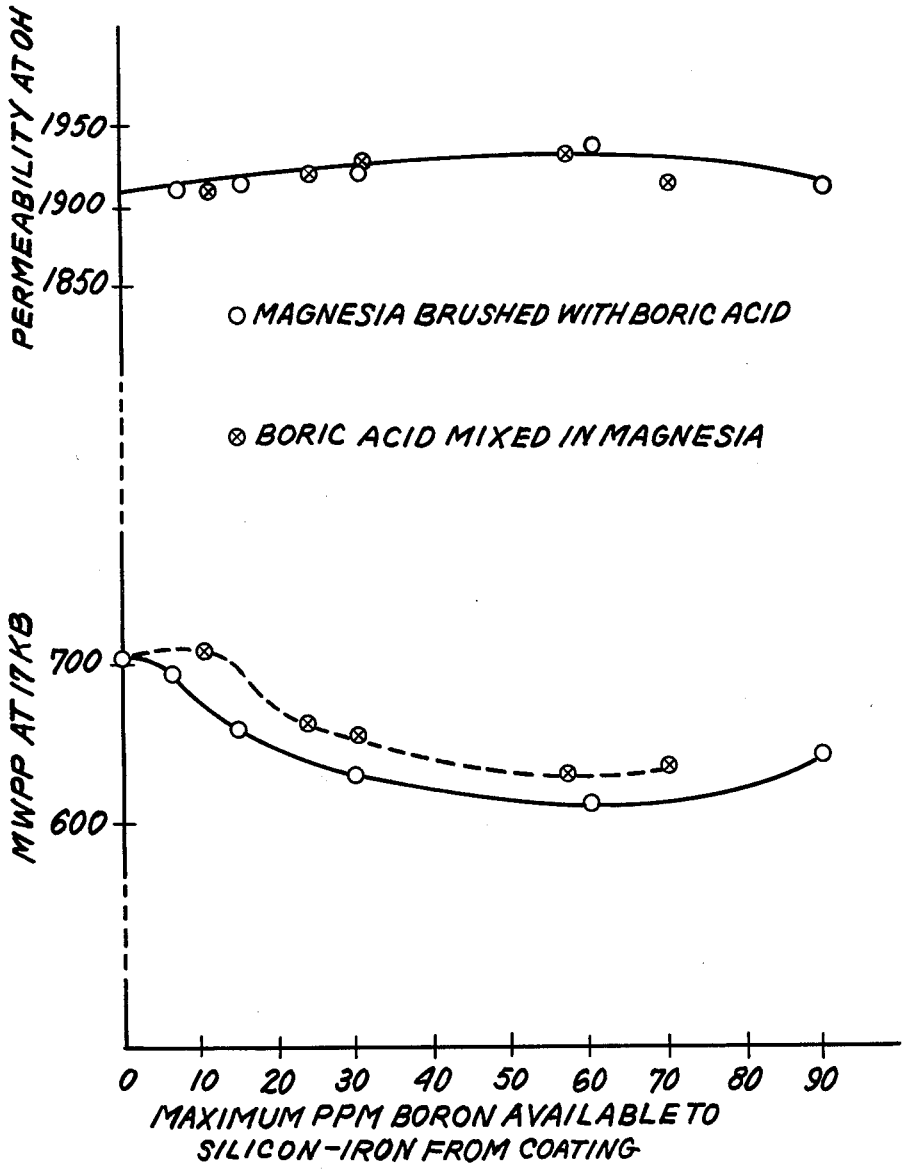
FIG. 3 is a chart on which both permeability and losses are plotted against maximum boron content available to the strip from the coating, the three curves showing relatively small improvement in permeability with increases in coating boron and somewhat greater improvements in losses over the same boron range.

Strips were cut from the cold rolled and decarburized sheet to provide Epstein packs, some of the strips being provided with magnesia coating as described in Example I and then being brushed with boric acid solution as therein described to provide varying amounts of boron from about 10 to about 90 ppm, as illustrated in FIG. 3. Others of the strips were coated with magnesia in which boric acid was premixed to provide varying amounts of available boron ranging from 10 to 70 ppm as shown in the drawing. Epstein Packs made of these prepared specimens and others coated but not borated were loaded into the retort for final anneal at 800° C. and heated at the rate of 40° C. per hour to the maximum temperature of 1175° C., which was held for four hours. The resulting annealed finished test specimens were subjected to tests of their magnetic properties with the results indicated in FIG. 3. In addition, the grain size of a number of the specimens were measured. The grain size of the control sample in which there was no boron available to the silicon-iron coating was 9.8 mm, while that of the 15 ppm boron coating was 11.3 mm, that of the 30 ppm boron coating was 10.4 mm, and that of the 60 ppm boron coating was 11.5 mm. This latter data stands in contrast to that disclosed in the prior art to the effect that reduction in grain size from 12 mm to 4 mm results in losses reduction approximating 50 mwpp.

It is apparent from FIG. 3 that boron additions to the coating of boron-containing silicon-iron result in sufficient reduction in losses and somewhat less change in permeability, i.e., relatively slight increases in permeability, over the range virtually from 5 to 10 ppm to 90 ppm of boron available to the silicon-iron from the coating.

EXAMPLE III

In another experiment like that described in Example I 11 laboratory heats were prepared in an air induction furnace either under an argon cover with argon bubbled through the melt prior to pouring, or with nitrogen used for the cover, the bubble, or both. The use of argon alone gave the lowest heat nitrogen contents and the use of nitrogen alone resulted in the highest heat nitrogen contents. The heats all contained 3.1 percent silicon, 0.1 percent copper and 0.03 percent chromium. Cold-rolled strip prepared as described in Example I from each of the heats were found on analysis to have the composition set forth in Table III:

TABLE III

Composition of Heats As Determined on Cold-Rolled Strip

| Heat | % Mn | % S | % C | ppm B | ppm N |
|---|---|---|---|---|---|
| 20 | 0.025 | 0.011 | 0.036 | 7.8 | 42 |
| 21 | 0.027 | 0.010 | 0.035 | 6.2 | 48 |
| 22 | 0.025 | 0.010 | 0.033 | 9.2 | 84 |
| 30 | 0.025 | 0.010 | 0.033 | 51.0 | 84 |
| 23 | 0.027 | 0.013 | 0.036 | 6.7 | 43 |
| 24 | 0.025 | 0.014 | 0.029 | 7.2 | 55 |
| 25 | 0.025 | 0.013 | 0.030 | 7.7 | 62 |
| 26 | 0.025 | 0.013 | 0.030 | 8.2 | 72 |
| 27 | 0.024 | 0.017 | 0.030 | 6.3 | 42 |
| 28 | 0.024 | 0.018 | 0.032 | 5.9 | 60 |
| 29 | 0.025 | 0.019 | 0.031 | 6.7 | 93 |

Epstein-size strips of the cold rolled materials were decarburized to less than 0.01 percent carbon at 800° C. in hydrogen (dew point about 70° F.). The strips were then brushed with milk of magnesia for a weight gain of about 40 mg per strip and boron additions were made to a number of the strip coatings by boric acid solutions of concentrations in multiples of 0.5 percent. Analyses of the coatings for boron prior to the final anneal indicated that the concentrations increased linearly by approximately 12 ppm boron (on the basis of strip rather than coating weight) for each such 0.5 percent increment. The final anneal consisted of heating at 40° C. per hour from 800° to 1175° C. and holding for three hours.

Figures 4, 5, 6:
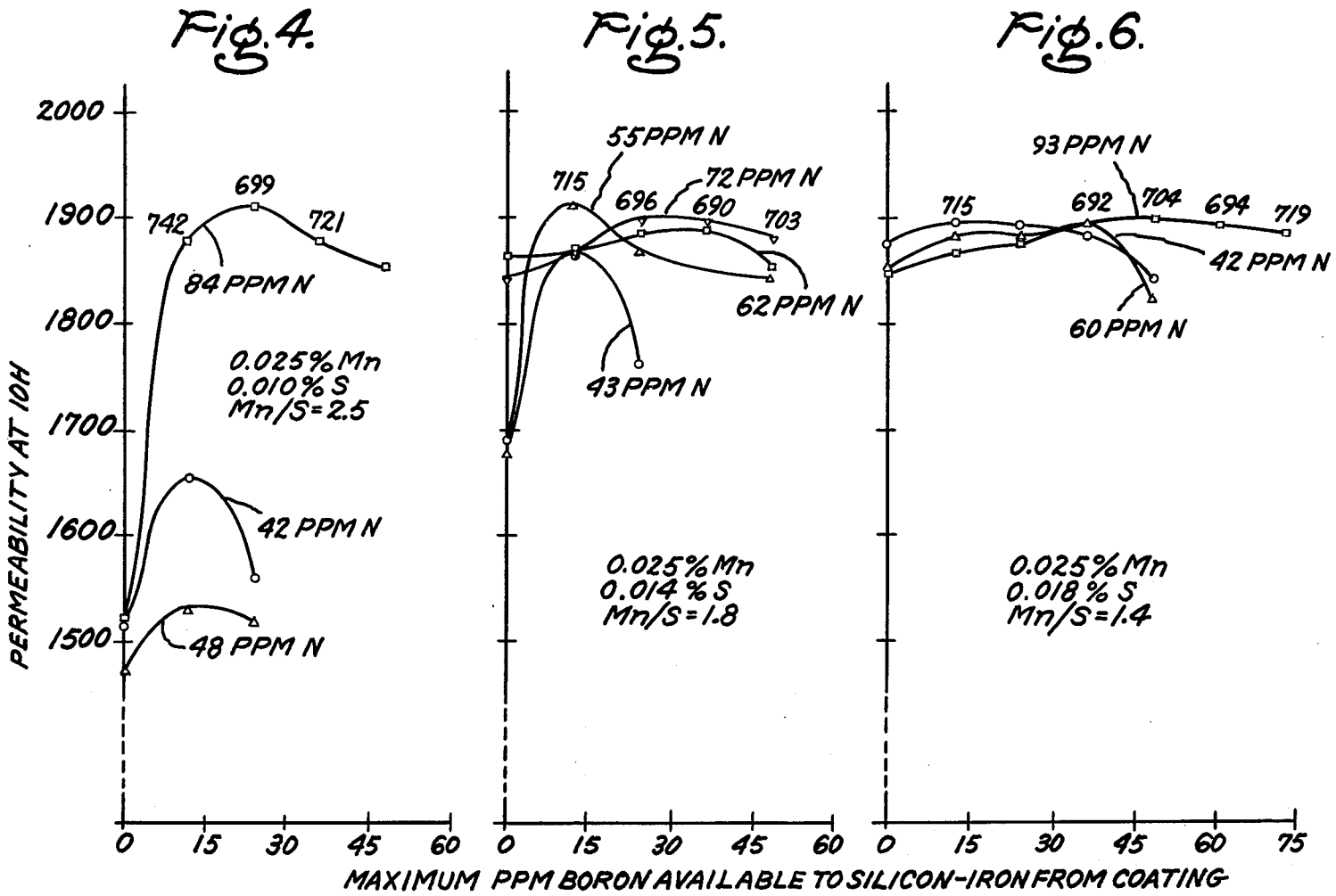
FIG. 4 is another chart on which permeability is plotted against maximum boron available to the strip from its coating, the four curves showing the effect of increasing metal nitrogen content from 42 to 84 ppm and one of them also showing the effect of increasing the metal boron content from about nine to 50 ppm.
FIG. 5 is a chart like that of FIG. 4 for metal specimens of 40% greater sulfur content.
FIG. 6 is a chart like those of FIGS. 4 and 5, the curves representing data collected in tests of metal processed in accordance with this invention having still greater sulfur content.

The permeabilities of Epstein Packs annealed with and without the boric acid additions to the strip coatings are illustrated in FIGS. 4, 5 and 6 where the heats are grouped according to sulfur content, as shown. The nitrogen contents of the strips prior to final anneal are also indicated on the drawings. In addition, in FIGS. 4–6, measured losses are entered adjacent to a number of the appropriate data points. All the heats were found to have improved properties through boron additions to the coating, the most dramatic improvement occurring with the low sulfur, high nitrogen heat. Without an addition of boron to the coating, all four low sulfur heats primarily undergo normal gain growth but with boron added to the coating, the high nitrogen heat undergoes complete secondary recrystallization. The tendency for high nitrogen heats to develop high permeabilities is also evident with heats of intermediate sulfur content: the lowest nitrogen heat is poorer than any of the others in the group.

It was also observed that adverse effects such as blisters and slivers commonly associated with relatively high nitrogen contents in silicon-iron were not evident in any of the speciments of this experiment.

Throughout this specification and the appended claims, as well as in the drawings, the boron content of the coating is expressed in terms of the total amount theoretically available to the silicon-iron strip bearing the coatings. In actual practice a small fraction of such boron will diffuse into the strip during the final anneal prior to completion of secondary recrystallization. Depending upon the circumstances that fraction may be as high as approximately one-half of the content of low boron content coatings.

What I claim as new and desire to secure by Letters Patent of the United States is:

1. The method of producing grain-oriented silicon-iron sheet which comprises the steps of providing a fine-grained, primary-recrystallized, silicon-iron sheet containing 2.2 to 4.5 percent silicon, between about 1.5 and 7.5 parts per million boron, amounts of manganese and sulfur within a ratio of manganese to sulfur less than 2.5, and between about 30 and 90 parts per million nitrogen in the ratio to boron of one to 15 parts per part of boron, covering the sheet with an electrically-insulating adherent coating containing about 15 parts per million boron on the basis of the silicon-iron sheet, the total amount of boron in the sheet and boron in the coating available to the sheet being between about 16.5 and about 22.5 parts per million, and subjecting the coated sheet to a final heat treatment to develop (110) secondary recrystallization texture in the silicon-iron sheet.

2. The method of claim 1 in which the boron content of the silicon-iron sheet is about 1.5 parts per million, the nitrogen content of the sheet is about 50 parts per million, and the coating contains about 15 parts per million boron on the basis of the silicon-iron sheet.

3. The method of claim 1 in which the boron content of the silicon-iron sheet is about 6.9 parts per million, the nitrogen content of the sheet is about 50 parts per million, and the coating contains about 15 parts per million boron on the basis of the silicon-iron sheet.

4. An electrically-insulating magnetic sheet material comprising a fine-grained, primary-recrystallized, magnetic, silicon-iron sheet containing 2.2 to 4.5 percent silicon, between about 1.5 and 7.5 parts per million boron, amounts of manganese and sulfur within a ratio of manganese to sulfur less than 2.5, and between about 30 and 90 parts per million nitrogen and having thereon a coating of a water-insoluble hydroxide of a metal selected from the group consisting of calcium, magnesium, manganese and aluminum, said coating containing about 15 parts per million boron on the basis of the silicon-iron sheet and so proportioned to the boron content of the said sheet that the total amount of boron in the sheet and boron in the coating available to the sheet is between about 16.5 and 22.5 parts per million.

5. The method of producing grain-oriented silicon-iron sheet which comprises the steps of providing a fine-grained, primary-recrystallized, silicon-iron sheet containing 2.2 to 4.5 percent silicon, between about six and 50 parts per million boron, between about 0.010 and 0.018 percent sulfur and between about 40 and 90 parts per million nitrogen in the ratio to boron of one to 15 parts per part of boron, covering the sheet with an electrically-insulating adherent coating containing boron in quantity such that the total amount of boron in the sheet and boron in the coating available to the sheet is between about 15 and about 75 parts per million, and subjecting the coated sheet to a final heat treatment to develop (110) secondary recrystallization texture in the silicon-iron sheet.

6. The method of claim 5 in which the sulfur content of the silicon-iron sheet is about 0.010 percent and the boron and nitrogen contents of the silicon-iron sheet are about nine and about 84 parts per million, respectively.

7. The method of claim 5 in which the sulfur content of the silicon-iron sheet is about 0.018 percent and the boron and nitrogen content of the silicon-iron sheet are about 6.5 and 90 parts per million, respectively.

8. An electrically-insulating magnetic sheet material comprisng a fine-grained, primary-recrystallized, magnetic, silicon-iron sheet containing 2.2 to 4.5 percent silicon, between about six and 90 parts per million boron, between about 0.010 and 0.018 percent sulfur, and between about 40 and 90 parts per million nitrogen and having thereon a coating of a water-insoluble hydroxide of a metal selected from the group consisting of calcium, magnesium, manganese and aluminum, said coating containing boron in quantity such that the total amount of boron in the sheet and boron in the coating is between about 15 and 75 parts per million on the basis of the said sheet.

9. The sheet material of claim 8 in which the sulfur content of the silicon-iron sheet is about 0.010 percent and the boron and nitrogen contents of the said sheet are about nine and about 84 parts per million, respectively, and the total amount of boron in the sheet and in the coating is about 30 parts per million on the basis of the sheet.

10. The sheet material of claim 8 in which the sulfur content of the silicon-iron sheet is about 0.014 percent and the boron and nitrogen contents of the sheet are about seven and about 55 parts per million, respectively, and the total amount of boron in the coating and in the sheet is about 15 parts per million on the basis of the sheet.

* * * * *